US007797874B2

(12) United States Patent
Neergaard

(10) Patent No.: US 7,797,874 B2
(45) Date of Patent: Sep. 21, 2010

(54) REAR APERTURE SIGHT FOR RIFLE

(75) Inventor: Arthur Neergaard, 393 Oregon St., Cincinnati, OH (US) 45202

(73) Assignee: Arthur Neergaard, Cincinnati, OH (US)

( * ) Notice: Subject to any disclaimer, the term of this patent is extended or adjusted under 35 U.S.C. 154(b) by 767 days.

(21) Appl. No.: 11/619,953

(22) Filed: Jan. 4, 2007

(65) Prior Publication Data

US 2008/0163535 A1 Jul. 10, 2008

(51) Int. Cl.
*F41G 1/00* (2006.01)

(52) U.S. Cl. ..... 42/111

(58) Field of Classification Search ..... 42/111, 42/133

See application file for complete search history.

(56) References Cited

U.S. PATENT DOCUMENTS

| | | | | |
|---|---|---|---|---|
| 207,684 | A | 9/1878 | Rowell | |
| 306,099 | A | 10/1884 | Plettner | |
| 360,837 | A | 4/1887 | Wright | |
| 468,206 | A | 2/1892 | Parker | |
| 504,696 | A | 9/1893 | Armitstead | |
| 744,651 | A | 11/1903 | Vickery | |
| 1,111,332 | A | 9/1914 | Viogt | |
| 1,142,665 | A | 5/1915 | Burton | |
| 1,198,888 | A | 9/1916 | Bullen | |
| 1,363,553 | A | 12/1920 | Barringer | |
| 1,406,620 | A | 2/1922 | Dear | |
| 1,425,321 | A | 8/1922 | Etherington | |
| 1,476,806 | A | 12/1923 | Eustege | |
| 1,850,288 | A | 3/1932 | Robbins | |
| 2,339,723 | A * | 1/1944 | Russell | 42/130 |
| 2,488,836 | A | 11/1949 | Sweetman | |
| 3,456,351 | A | 7/1969 | Gehmann | |
| 3,777,380 | A | 12/1973 | Theodore | |

(Continued)

FOREIGN PATENT DOCUMENTS

| | | |
|---|---|---|
| BE | 857347 | 1/1977 |

(Continued)

OTHER PUBLICATIONS

Declaration of Arthur Neergaard, 11 pages, plus 4 sheets of drawings, totaling 15 pages, dated Jun. 29, 2010.

(Continued)

*Primary Examiner*—Troy Chambers
(74) *Attorney, Agent, or Firm*—Wood, Herron & Evans, LLP

(57) ABSTRACT

A rear aperture sight for use in conjunction with a front sight post sight on a rifle. The front sight post has a horizontal top edge and vertical side edges. The rear aperture sight comprises a rear sight adapted to be mounted on the rifle. The rear sight has a horizontally elongated aperture formed therein having height and width dimensions. The width dimension is greater than the height dimension. The height dimension is of such a value that the aperture is adapted to cause the horizontal top edge of the front sight post and a horizontal edge of a target to be sharply focused. The width dimension is of such a value that the aperture is adapted to permit a sufficient amount of light to pass through the aperture so that the front sight post and the target are bright.

36 Claims, 3 Drawing Sheets

U.S. PATENT DOCUMENTS

Figure 1:
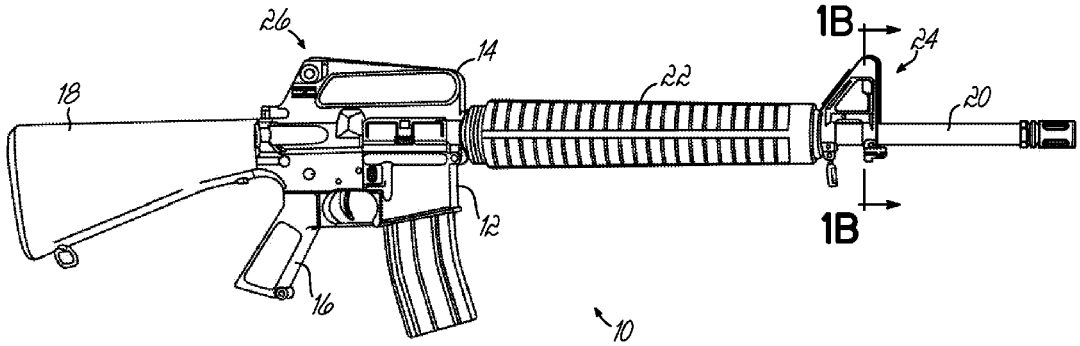

| | | | | |
|---|---|---|---|---|
| 3,861,050 | A | 1/1975 | Mauro | |
| 3,886,667 | A | 6/1975 | Rueb | |
| 4,366,625 | A | 1/1983 | Gehmann | |
| 4,745,698 | A | 5/1988 | Schwulst | |
| 5,080,084 | A | 1/1992 | Kendall | |
| D382,038 | S | 8/1997 | Nigh | |
| 5,822,872 | A * | 10/1998 | Waki | 42/111 |
| 5,882,872 | A | 3/1999 | Kudsk | |
| 5,933,972 | A | 8/1999 | Springer, Jr. | |
| D443,016 | S | 5/2001 | Nigh | |
| 6,321,479 | B1 | 11/2001 | Sheehan | |
| 6,360,473 | B1 | 3/2002 | Merchant | |
| D460,512 | S | 7/2002 | Sheehan | |
| 6,628,464 | B1 * | 9/2003 | Johnson | 359/894 |
| 6,678,987 | B2 * | 1/2004 | Howe | 42/132 |
| 6,860,056 | B2 | 3/2005 | Howe | |
| 2007/0074441 | A1 * | 4/2007 | Howe | 42/111 |

FOREIGN PATENT DOCUMENTS

| | | | |
|---|---|---|---|
| DE | 10020440 | A1 | 6/2001 |
| DE | 20203376 | U1 | 6/2002 |

OTHER PUBLICATIONS

Drawing 6008868, US Army Arsenal Drawing of the M-1 Rifle Aperture, dated Aug. 2, 1937.

Drawing 5546001, US Army Arsenal Drawing of the M-1 Rifle Rear Sight Base, dated Aug. 2, 1937.

* cited by examiner

REAR APERTURE SIGHT FOR RIFLE

FIELD OF THE INVENTION

This invention relates generally to firearms, and more particularly to sighting systems for firearms.

BACKGROUND OF THE INVENTION

The United States military issues for service a pair of shoulder fired small arms both chambered for the 5.56 mm NATO cartridge. One is designated the M16A2/M16A3/M16A4 rifle and the other is designated the M4/M4A1 carbine. Both weapons utilize a common sighting system comprising a rear sight having a leaf with a circular aperture therein and a front sight post. To properly aim the weapon, the horizontal top edge of the front sight post is centered horizontally and vertically on the target, and is also centered in the rear aperture.

Both weapons utilize a rear flip type dual leaf sight having two different aperture sizes from which to choose: a smaller aperture having a diameter of about 0.070 inch for longer ranges, and a larger aperture having a diameter of about 0.2 inch for shorter ranges, a greater field of view, and faster target engagement. The shooter flips the sight leaf having the correct aperture up into view based on the distance to the target. The larger aperture is for near targets, generally less than 200 meters, and the smaller aperture is for distant targets, generally greater than 200 meters.

The larger aperture permits a shooter to locate the front sight post and target in the rear aperture quicker than does the smaller aperture. Hence its suitability for near targets wherein engagements are quicker. The smaller aperture does not permit the shooter to locate the front sight post and target therein as quickly as the larger aperture, but it does provide for more accurate aiming which is necessary at longer ranges. This is because the smaller aperture acts as a pinhole opening, and improves the shooter's depth of field. The small vertical dimension of the circular hole causes the horizontal top edge of the front sight post and any horizontal edges on the target to be more clearly focused, and the small horizontal dimension of the circular hole causes the vertical side edges of the front sight post, and any vertical edges on the target, to be more clearly focused. This is in contrast to the larger aperture which does not focus the horizontal top edge of the front sight post, the vertical side edges of the front sight post, or the target as much, so they remain somewhat blurry to the shooter. Again, the larger aperture is for near targets, and so speed in aiming is paramount; even though the horizontal top edge and vertical side edges of the front sight post, and the target, are blurry, the sight picture is nonetheless sufficient to obtain accurate hits at closer ranges.

A distinct disadvantage in using the smaller rear circular aperture is that less light is permitted to pass through the aperture. Thus, even though the horizontal top edge and vertical side edges of the front sight post and target are clearly focused which enhances accuracy in aiming and hence accuracy in shot placement, the front sight post and target are nevertheless dim, which hinders accuracy in aiming ability and hence accuracy in shot placement.

In competition shooting with the U.S. service rifle, for example in NRA High Power rifle competition, it is customary to utilize a "6 o'clock hold." This means that the horizontal top edge of the front sight post is placed at the bottom edge of the circular bull's eye of the target, i.e. at 6 o'clock. Experience has shown that the most important features to be in focus for an accurate 6 o'clock hold, and hence accurate target shooting, are the horizontal top edge of the front sight post, and the horizontal bottom edge of the target. The focus of the vertical side edges of the front sight post and of the vertical side edges of the target are less critical.

A problem with traditional round aperture sights is that once the aperture is reduced in size to provide optimal focus on the horizontal top edge of the front sight post and the horizontal bottom edge of the target, the amount of light passing through the opening is so limited that the target and the front sight post appear dim to the shooter. In other words, a sub-optimal focus must be accepted in order for the amount of light passing through the opening to be sufficient for the front sight post and target to appear bright to the shooter.

Accordingly, it is desirable to provide a rear aperture sight for a rifle which causes the horizontal top edge of the front sight post and the horizontal bottom edge of the bull's eye to be as sharply focused as possible, but which at the same time does not restrict the amount of light able to pass through the aperture so as to prevent the front sight post and target from being dim.

SUMMARY OF THE INVENTION

In one aspect, the present invention is a rear aperture sight for use in conjunction with a front sight post sight on a rifle, the front sight post having a horizontal top edge and vertical side edges. The rear aperture sight comprises a rear sight adapted to be mounted on the rifle. The rear sight has a horizontally elongated aperture formed therein having height and width dimensions. The width dimension is greater than the height dimension. The height dimension is of such a value that the aperture is adapted to cause the horizontal top edge of the front sight post and a horizontal edge of a target to be sharply focused. The width dimension is of such a value that the aperture is adapted to permit a sufficient amount of light to pass through the aperture so that the front sight post and the target are bright.

In another aspect, the invention is a rifle having a receiver and a barrel, and having the rear aperture sight and the front sight post sight of the above mounted on the receiver and barrel, respectively.

In yet another aspect, the invention is the combination of the rear aperture sight and the front sight post sight of the above.

The aperture of the rear sight can have a number of possible width-to-height aspect ratios, width and height dimensions, and shapes. The width dimension can be in a range of about 110% to about 500% of the height dimension; the width dimension can be in a range of about 120% to about 300% of the height dimension; the width dimension can be in a range of about 140% to about 160% of the height dimension. The height dimension can be in a range of about 0.010 inch to about 0.100 inch. The width dimension can be in a range of about 0.011 inch to about 0.20 inch. The aperture can be rectangular shaped, rectangular shaped with radiused corners, oval shaped, hexagonal shaped with vertices positioned at 3 o'clock and at 9 o'clock, and/or elliptical shaped. The rear sight can be a leaf sight.

The invention thus provides a rear aperture sight for a rifle which sharply focuses the horizontal top edge of the front sight post and the horizontal bottom edge of the target, while at the same time permitting sufficient light to pass therethrough so that the front sight post and target are bright.

These and other features and advantages of the present invention will become more readily apparent during the following detailed description taken in conjunction with the drawings herein, in which:

BRIEF DESCRIPTION OF THE DRAWINGS OF THE INVENTION

Figure 1A:
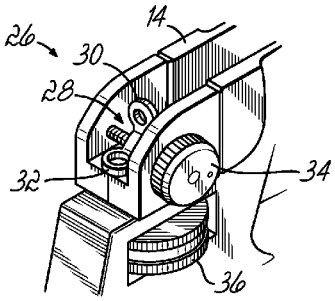
PRIOR ART FIG. 1A
Figure 1B:
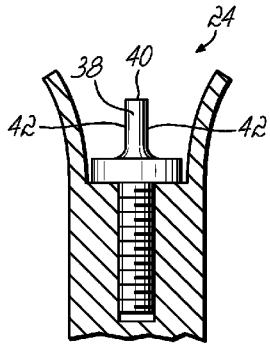
PRIOR ART FIG. 1B
Figure 2:
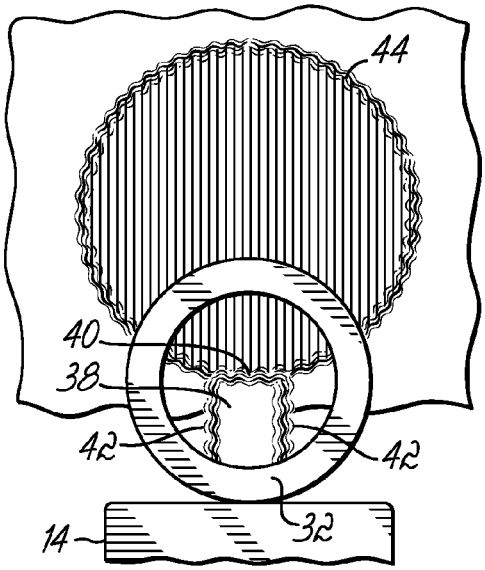
PRIOR ART FIG. 2
Figure 3:
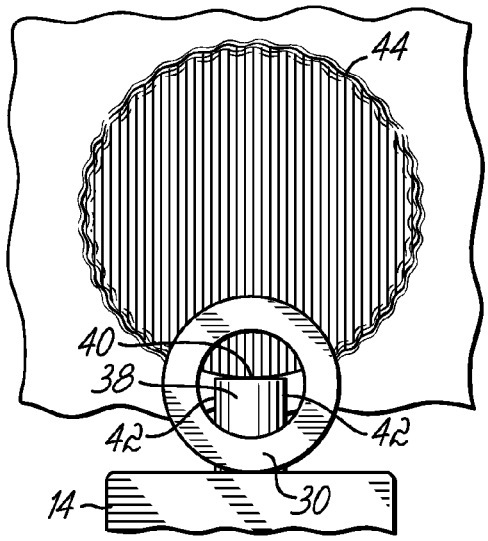
PRIOR ART FIG. 3
Figure 4:
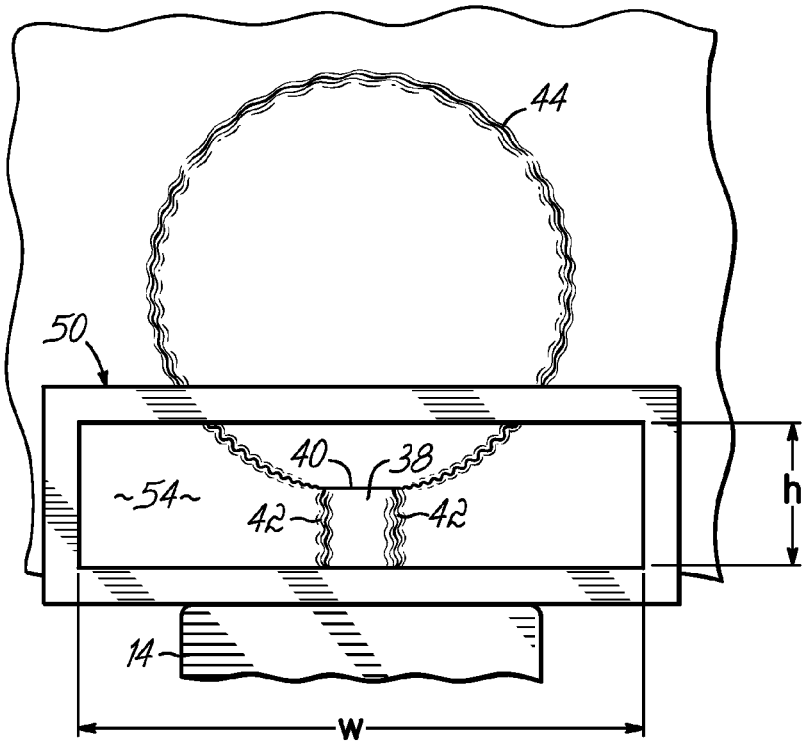
Figure 5A:
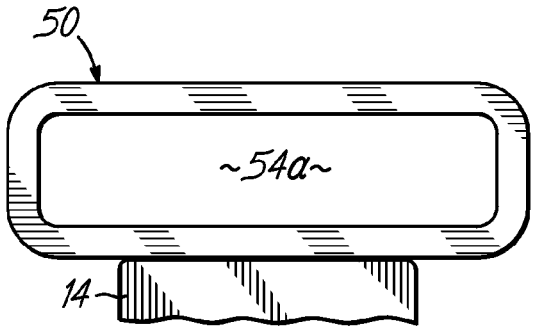
Figure 5B:
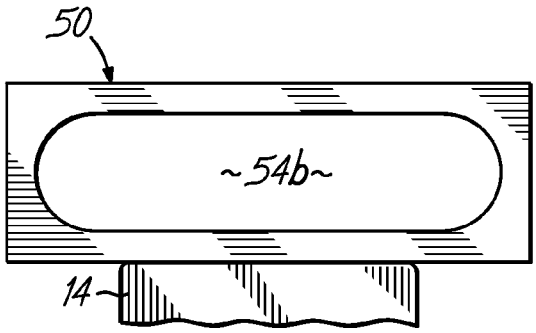
Figure 5C:
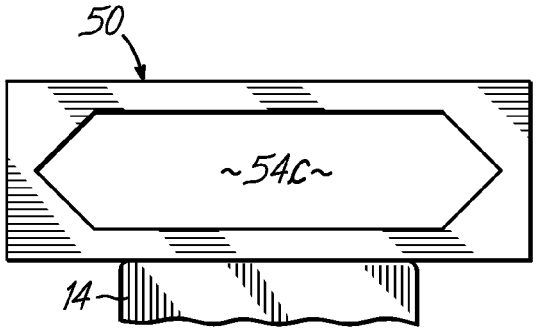
Figure 5D:
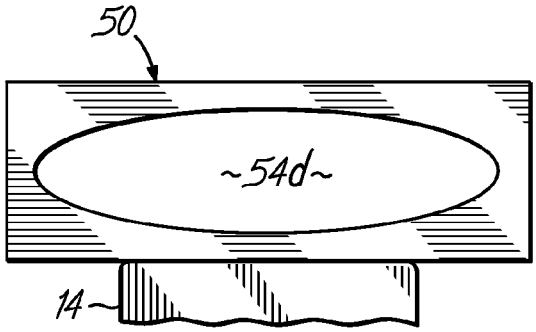

FIG. 1 is a side view of the United States military M16A2 service rifle,

FIG. 1A is a rear perspective view of the prior art rear sight of the rifle of FIG. 1, FIG. 1B is a partial cross-sectional view through the prior art front sight of the rifle of FIG. 1 along line 1B-1B in FIG. 1, FIG. 2 is a sight picture looking through the sights of the rifle of FIG. 1 using the prior art large circular aperture rear sight, FIG. 3 is a sight picture looking through the sights of the rifle of FIG. 1 using the prior art small circular aperture rear sight, FIG. 4 is a sight picture looking through the sights of a rifle equipped with one embodiment of the present invention, FIGS. 5A-D are sight pictures looking through the rear aperture sight of a rifle equipped with second, third, fourth, and fifth embodiments of the present invention.

DETAILED DESCRIPTION OF PREFERRED EMBODIMENTS OF THE INVENTION

Referring first to FIG. 1, there is illustrated the United States military M16A2 service rifle 10, comprising, generally, lower receiver 12, upper receiver 14, pistol grip 16, buttstock 18, barrel 20, handguard 22, front sight assembly 24 and rear sight assembly 26. FIG. 1A shows the prior art rear sight assembly 26 in more detail. It comprises a flip type dual leaf sight 28 having a smaller aperture 30 having a diameter of about 0.070 inch for longer ranges, and a larger aperture 32 having a diameter of about 0.2 inch for shorter ranges. A windage knob 34 is used to adjust the windage of the rear sight assembly 26. An elevation knob 36 is used to adjust the elevation of the rear sight assembly 26 for ranges beyond 300 meters. FIG. 1B shows the prior art front sight assembly 26 in more detail. It comprises a post 38 which is adjustable but which is only used to initially zero the rifle. (As used herein, the term "post" shall be deemed to embrace any front sight aiming device, such as posts, pins, blades, etc.) The post 38 has a horizontal top edge 40 and vertical side edges 42, 42.

FIG. 2 shows the sight picture when aiming at a bull's eye target 44 with the post 38 and large aperture 32. The horizontal top edge 40 and vertical side edges 42, 42 of the post 38, as well as the target edge within and outside the aperture 32, appear fuzzy or out of focus. Thus, precise alignment of the horizontal top edge 40 of the post 38 with the lower edge of bull's eye 44, i.e. a precise 6 o'clock hold, is not possible. FIG. 3 shows the sight picture when aiming at the bull's eye 44 with the post 38 and small aperture 30. The horizontal top edge 40 and vertical side edges 42, 42 of the post are sharply focused. However, the smaller aperture permits less light to pass through the aperture. Thus, even though the horizontal top edge 40 and vertical side edges 42, 42 of the front sight post 38, and target, are clearly focused, the front sight post 38 and bull's eye 44 are nevertheless dim, thus negating the positive effects on accuracy from the clearly focused front sight post 38.

FIG. 4 illustrates a rear aperture sight 50 for a rifle according to the principals of the invention. The sight 50 can be a leaf 52 which is adapted to be mounted to the rifle 10 (or to any other rifle). The sight leaf 52 has a horizontally elongated aperture 54 formed therein having height h and width w dimensions. The width w is greater than the height h. The height h is of such a value that the aperture 54 is adapted to cause the horizontal top edge 40 of the front sight post 38, and the horizontal edge of the target 44, to be sharply focused, thereby permitting precise alignment of the horizontal top edge 40 with the lower edge of the bull's eye 44. The width w is of such a value that the aperture 54 permits a sufficient amount of light to pass therethrough so that the front sight post 38 and bull's eye 44 are bright. The focus of the vertical side edges 42, 42 of the front sight post 38, and of the vertical edges of the target 44, is sacrificed, and they appear fuzzy or out of focus. However, it has been determined that this is of minor consequence, as it suffices for the shooter to simply center the two vertical side edges 42, 42, albeit blurry, relative to the bull's eye 44. The shooter does not need to precisely line up either of the these edges with the bull's eye, as is the case for the top edge of the post.

Preferably, the width w is in a range of about 110% to about 500% of the height h. More preferably, the width w is in a range of about 120% to about 300% of the height h. Most preferably, the width w is in a range of about 140% to about 160% of the height h. Other width w to height h aspect ratios can of course be used, and the invention is not to be limited to the values specified herein.

Preferably, the height h is in a range of about 0.010 inch to about 0.100 inch. Preferably, the width w is in a range of about 0.011 inch to about 0.20 inch. Other width w and height h dimensions can of course be used, and the invention is not to be limited to the values specified herein.

The aperture 54 can be rectangular shaped as shown in FIG. 4. Alternatively, the aperture can be rectangular shaped with radiused corners as shown at 54*a* in FIG. 5A, oval shaped as shown at 54*b* in FIG. 5B, hexagonal shaped with vertices positioned at 3 o'clock and at 9 o'clock as shown at 54*c* in FIG. 5C, or elliptical shaped as shown at 54*d* in FIG. 5D. Other shapes can of course be used, and the invention is not to be limited to the shapes specified herein.

Those skilled in the art will readily recognize numerous adaptations and modifications which can be made to the present invention which will result in an improved aperture sight for a rifle, yet all of which will fall within the spirit and scope of the present invention as defined in the following claims. For example, the rear sight could be any structure capable of having an aperture formed therein, and not just the "leaf" shown in the drawings. Accordingly, the invention is to be limited only by the scope of the following claims and their equivalents.

What is claimed is:

1. A rear aperture sight for use in conjunction with a front sight post sight on a rifle, the front sight post having a horizontal top edge and vertical side edges, said rear aperture sight comprising:

a rear sight adapted to be mounted on the rifle, said rear sight having a horizontally elongated aperture formed therein having height and width dimensions, said width dimension being greater than said height dimension, said height dimension being of such a value that said aperture is adapted to cause the horizontal top edge of the front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing the front sight post and the target to appear brighter than if viewed through the circular aperture.

2. The sight of claim 1 wherein said width dimension is in a range of about 110% to about 500% of said height dimension.

3. The sight of claim 1 wherein said width dimension is in a range of about 120% to about 300% of said height dimension.

4. The sight of claim 1 wherein said width dimension is in a range of about 140% to about 160% of said height dimension.

5. The sight of claim 1 wherein said aperture is rectangular shaped.

6. The sight of claim 1 wherein said aperture is rectangular shaped with radiused corners.

7. The sight of claim 1 wherein said aperture is oval shaped.

8. The sight of claim 1 wherein said aperture is elliptical shaped.

9. A rear aperture sight for use in conjunction with a front sight post sight on a rifle, the front sight post having a horizontal top edge and vertical side edges, said rear aperture sight comprising:

a rear sight adapted to be mounted on the rifle, said rear sight having a horizontally elongated aperture formed therein having height and width dimensions, said width dimension being greater than said height dimension, said height dimension being of such a value that said aperture is adapted to cause the horizontal top edge of the front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing the front sight post and the target to appear brighter than if viewed through the circular aperture, wherein said height dimension is in a range of about 0.010 inch to about 0.100 inch.

10. A rear aperture sight for use in conjunction with a front sight post sight on a rifle, the front sight post having a horizontal top edge and vertical side edges, said rear aperture sight comprising:

a rear sight adapted to be mounted on the rifle, said rear sight having a horizontally elongated aperture formed therein having height and width dimensions, said width dimension being greater than said height dimension, said height dimension being of such a value that said aperture is adapted to cause the horizontal top edge of the front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing the front sight post and the target to appear brighter than if viewed through the circular aperture, wherein said width dimension is in a range of about 0.011 inch to about 0.20 inch.

11. A rear aperture sight for use in conjunction with a front sight post sight on a rifle, the front sight post having a horizontal top edge and vertical side edges, said rear aperture sight comprising:

a rear sight adapted to be mounted on the rifle, said rear sight having a horizontally elongated aperture formed therein having height and width dimensions, said width dimension being greater than said height dimension, said height dimension being of such a value that said aperture is adapted to cause the horizontal top edge of the front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing the front sight post and the target to a appear brighter than if viewed through the circular aperture, wherein said aperture is hexagonal shaped, with vertices positioned at 3 o'clock and at 9 o'clock.

12. A rifle having a receiver and a barrel, said rifle comprising:

a front sight post mounted on said barrel of said rifle, said front sight post having a horizontal top edge and vertical side edges, a rear sight mounted on said receiver of said rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture.

13. The rifle of claim 12 wherein said width dimension is in a range of about 110% to about 500% of said height dimension.

14. The rifle of claim 12 wherein said width dimension is in a range of about 120% to about 300% of said height dimension.

15. The rifle of claim 12 wherein said width dimension is in a range of about 140% to about 160% of said height dimension.

16. The rifle of claim 12 wherein said aperture is oval shaped.

17. The rifle of claim 12 wherein said aperture is elliptical shaped.

18. A rifle having a receiver and a barrel, said rifle comprising:

a front sight post mounted on said barrel of said rifle, said front sight post having a horizontal top edge and vertical side edges, a rear sight mounted on said receiver of said rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said height dimension is in a range of about 0.010 inch to about 0.100 inch.

19. A rifle having a receiver and a barrel, said rifle comprising:

a front sight post mounted on said barrel of said rifle, said front sight post having a horizontal top edge and vertical side edges, a rear sight mounted on said receiver of said rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said width dimension is in a range of about 0.011 inch to about 0.20 inch.

20. A rifle having a receiver and a barrel, said rifle comprising:

a front sight post mounted on said barrel of said rifle, said front sight post having a horizontal top edge and vertical side edges, a rear sight mounted on said receiver of said rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said aperture is rectangular shaped.

21. A rifle having a receiver and a barrel, said rifle comprising:

a front sight post mounted on said barrel of said rifle, said front sight post having a horizontal top edge and vertical side edges, a rear sight mounted on said receiver of said rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said aperture is rectangular shaped with radiused corners.

22. A rifle having a receiver and a barrel, said rifle comprising:

a front sight post mounted on said barrel of said rifle, said front sight post having a horizontal top edge and vertical side edges, a rear sight mounted on said receiver of said rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said aperture is hexagonal shaped, with vertices positioned at 3 o'clock and at 9 o'clock.

23. A combination rear aperture sight and front sight post sight for use on a rifle, said combination comprising:

a front sight post adapted to be mounted on a barrel of the rifle, said front sight post having a horizontal top edge and vertical side edges, a rear sight adapted to be mounted on the rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture.

24. The combination of claim 23 wherein said width dimension is in a range of about 110% to about 500% of said height dimension.

25. The combination of claim 23 wherein said width dimension is in a range of about 120% to about 300% of said height dimension.

26. The combination of claim 23 wherein said width dimension is in a range of about 140% to about 160% of said height dimension.

27. The combination of claim 23 wherein said aperture is oval shaped.

28. The combination of claim 23 wherein said aperture is elliptical shaped.

29. A combination rear aperture sight and front sight post sight for use on a rifle, said combination comprising:

a front sight post adapted to be mounted on a barrel of the rifle, said front sight post having a horizontal top edge and vertical side edges, a rear sight adapted to be mounted on the rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said height dimension is in a range of about 0.010 inch to about 0.100 inch.

30. A combination rear aperture sight and front sight post sight for use on a rifle, said combination comprising:

a front sight post adapted to be mounted on a barrel of the rifle, said front sight post having a horizontal top edge and vertical side edges, a rear sight adapted to be mounted on the rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said width dimension is in a range of about 0.011 inch to about 0.20 inch.

31. A combination rear aperture sight and front sight post sight for use on a rifle, said combination comprising:

a front sight post adapted to be mounted on a barrel of the rifle, said front sight post having a horizontal top edge and vertical side edges, a rear sight adapted to be mounted on the rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said aperture is rectangular shaped.

32. A combination rear aperture sight and front sight post sight for use on a rifle, said combination comprising:

a front sight post adapted to be mounted on a barrel of the rifle, said front sight post having a horizontal top edge and vertical side edges, a rear sight adapted to be mounted on the rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said aperture is rectangular shaped with radiused corners.

33. A combination rear aperture sight and front sight post sight for use on a rifle, said combination comprising:

a front sight post adapted to be mounted on a barrel of the rifle, said front sight post having a horizontal top edge and vertical side edges, a rear sight adapted to be mounted on the rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said aperture is hexagonal shaped, with vertices positioned at 3 o'clock and at 9 o'clock.

34. A rear aperture sight for use in conjunction with a front sight post sight on a rifle, the front sight post having a horizontal top edge and vertical side edges, said rear aperture sight comprising:

a rear sight adapted to be mounted on the rifle, said rear sight having a horizontally elongated aperture formed therein having height and width dimensions, said width dimension being greater than said height dimension, said height dimension being of such a value that said aperture is adapted to cause the horizontal top edge of the front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing the front sight post and the target to appear brighter than if viewed through the circular aperture, wherein said rear sight is a leaf sight.

35. A rifle having a receiver and a barrel, said rifle comprising:

a front sight post mounted on said barrel of said rifle, said front sight post having a horizontal top edge and vertical side edges, a rear sight mounted on said receiver of said rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said rear sight is a leaf sight.

36. A combination rear aperture sight and front sight post sight for use on a rifle, said combination comprising:

a front sight post adapted to be mounted on a barrel of the rifle, said front sight post having a horizontal top edge and vertical side edges, a rear sight adapted to be mounted on the rifle, said rear sight having a horizontally elongated aperture formed therein having height and width dimensions, said width dimension being greater than said height dimension, said height dimension being of such a value that said aperture causes said horizontal top edge of said front sight post and a horizontal edge of a target to be more sharply focused than if viewed with the naked eye, said width dimension being of such a value that an area defined by said aperture is greater than an area defined by a circular aperture having a diameter equal to said height dimension, thereby permitting more light to pass through said aperture than through the circular aperture, and causing said front sight post and the target to appear brighter than if viewed through the circular aperture, wherein said rear sight is a leaf sight.

* * * * *